US008161933B2

(12) United States Patent
Gast et al.

(10) Patent No.: US 8,161,933 B2
(45) Date of Patent: Apr. 24, 2012

(54) STARTER ARRANGEMENT FOR AN INTERNAL COMBUSTION ENGINE

(75) Inventors: Peter Gast, Torslanda (SE); Jonas Forssell, Torslanda (SE); Lars Stenvall, Ljungskile (SE); Petter Almhagen, Floda (SE)

(73) Assignee: Volvo Car Corporation, Göteborg (SE)

( * ) Notice: Subject to any disclaimer, the term of this patent is extended or adjusted under 35 U.S.C. 154(b) by 798 days.

(21) Appl. No.: 12/336,321

(22) Filed: Dec. 16, 2008

(65) Prior Publication Data

US 2009/0151684 A1 Jun. 18, 2009

(30) Foreign Application Priority Data

Dec. 17, 2007 (EP) ..... 07123346

(51) Int. Cl.
*F02N 11/00* (2006.01)

(52) U.S. Cl. ..... 123/179.25; 74/7 C; 192/42

(58) Field of Classification Search ..... 123/179.24, 123/179.25, 179.27; 290/38 R, 38 C, 38 E; 74/6, 7 C, 15.63; 903/902; 192/12 B, 42, 192/41 R See application file for complete search history.

(56) References Cited

U.S. PATENT DOCUMENTS

| | | | | |
|---|---|---|---|---|
| 4,197,885 | A * | 4/1980 | Mortensen | 74/6 |
| 7,472,672 | B2 * | 1/2009 | Asada et al. | 123/179.25 |
| 7,559,303 | B2 * | 7/2009 | Sakai et al. | 123/179.25 |
| 2007/0034030 | A1 * | 2/2007 | Suzuki et al. | 74/6 |
| 2008/0121202 | A1 * | 5/2008 | Asada et al. | 123/185.14 |
| 2008/0163842 | A1 * | 7/2008 | Forssell et al. | 123/179.25 |

FOREIGN PATENT DOCUMENTS

| | | | |
|---|---|---|---|
| CN | 1590797 | A | 3/2005 |
| DE | 2714029 | B * | 7/1978 |
| EP | 1457669 | | 9/2004 |
| JP | 59113256 | | 6/1984 |
| JP | 2000274337 | | 10/2000 |
| JP | 2000291517 | | 10/2000 |

OTHER PUBLICATIONS

ISA European Patent Office, International Search Report of EP07123346, May 28, 2008, 1 page.

Notification of First Office Action of Chinese Patent Application No. 200810188463.X, Aug. 3, 2011, 2 pages, State Intellectual Property Office of PRC.

* cited by examiner

*Primary Examiner* — Stephen K Cronin
*Assistant Examiner* — Arnold Castro
(74) *Attorney, Agent, or Firm* — Alleman Hall McCoy Russell & Tuttle LLP

(57) ABSTRACT

A starter arrangement for an internal combustion engine the arrangement including a starter motor having a pinion gear coupled to an output shaft, the pinion gear being arranged in constant engagement with a corresponding crank gear of a crank wheel located between an engine block and a flywheel of the engine. The crank wheel is operatively coupled to a crankshaft of the engine via a one-way clutch unit loosely fitted to an end of the crankshaft, the crankshaft including a circumferential slot carrying a clip ring. The one-way clutch unit including a tube shaped hub loosely fitted to an end of the crankshaft, the axial movement of the one-way hub is fixed via a clip-ring in co-operation with a first axially delimiting member and a second axially delimiting member at least partially enclosed by the hub.

20 Claims, 3 Drawing Sheets

STARTER ARRANGEMENT FOR AN INTERNAL COMBUSTION ENGINE

CROSS REFERENCE TO RELATED APPLICATION

This present application claims priority to European Application Number 07123346, filed Dec. 17, 2007, entitled "Starter Arrangement for an Internal Combustion Engine", naming Peter Gast, Jonas Forssell, Lars Stenvall, and Petter Almhagen as inventors, the entire contents of which are incorporated herein by reference.

TECHNICAL FIELD

The present invention is related to a starter arrangement for an internal combustion engine. Furthermore, the present invention relates to a method for mounting a one-way clutch unit of a starter arrangement for an internal combustion engine.

BACKGROUND OF THE INVENTION

A so called start-stop or idle-stop arrangement is based on the concept of halting combustion in a vehicle's engine during vehicle standstill (e.g. when waiting for a traffic light to change from red to green). Such an arrangement may allow for substantial savings in fuel consumption. For mixed highway/rural and city driving savings of at least 2-4% are feasible and for city driving savings of up to 10% are feasible.

Some previous attempts to provide such arrangements have been based on belt drives or have been starter based. Starter based systems are low cost and scalable to all sizes and kinds of power-trains but have two major drawbacks. On the one hand they cannot be engaged during engine ramp down and on the other hand they are quite noisy due to engagement noise and cranking noise.

One previous attempt at addressing the above problems with starter based systems is provided by JP 2000 274337, which describes a starting device for a vehicle, such as an idle stop car or a hybrid car, which starting device is especially suited for noise reduction. The starting device is provided with a pinion gear on the output shaft of an electric motor.

A ring gear is engaged and always meshes with the pinion gear. Between the ring gear and a crankshaft is arranged a one-way clutch which intervenes between the ring gear and the crankshaft, and which is arranged to permit only the transmission of driving force from the side of the electric motor to the internal combustion engine for starting thereof. The one-way clutch is built in between the ring gear and a flywheel of the internal combustion engine. In order to reduce the noise generated, the dental rate of engagement and engagement precision are raised, which is enabled through the ring gear being engaged and always meshing with the pinion gear.

Although JP 2002 74337 addresses the noise and engagement problems by the ring gear engaging and always meshing with the pinion gear a new problem is introduced. As the internal combustion engine of an idle stop vehicle or a hybrid vehicle will be brought to start automatically, e.g. by an onboard computer, the number of hourly starts and stops will be quite considerable, especially during city driving. This is likely to put considerable strain on the one-way clutch of the starter arrangement. Thus, it is not desirable to have the one-way clutch built in between the ring gear and the flywheel of the internal combustion engine according to JP 2002 74337, but would be preferable to arrange the one-way clutch directly at the crankshaft, in order to provide a smaller and more compact arrangement which could be applicable to a lager number of existing internal combustion engines.

However, it has been found that in order to appropriately affix a hub of the one-way clutch to the crankshaft the hub may be press fitted thereupon using special tooling applying considerable force. This makes it cumbersome to mount the one-way clutch, and certainly even more cumbersome to dismount and service the arrangement at an ordinary garage.

SUMMARY OF THE INVENTION

An object of the present invention is to provide an improved starter arrangement for an internal combustion engine, and a starter arrangement which is easily mounted and dismounted. The starter arrangement may include a starter motor having a pinion gear coupled to an output shaft, the pinion gear being arranged in constant engagement with a corresponding crank gear of a crank wheel located between an engine block and a flywheel of the engine. The crank wheel is operatively coupled to a crankshaft of the engine via a one-way clutch unit loosely fitted to an end of the crankshaft, the crankshaft including a circumferential slot carrying a clip ring. The one-way clutch unit including a tube shaped hub loosely fitted to an end of the crankshaft, the axial movement of the one-way hub is fixed via a clip-ring in co-operation with a first axially delimiting member and a second axially delimiting member at least partially enclosed by the hub.

A further object of the present invention is to provide an improved method for mounting a one-way clutch unit onto a crankshaft. The one way clutch unit is included in a starter arrangement for an internal combustion engine. The starter arrangement includes a starter motor having a pinion gear operably coupled to a starter motor, the pinion gear is in constant engagement with a corresponding crank gear of a crank wheel located between an engine block and a flywheel of the engine. The crank wheel is operatively connected to a crankshaft of the engine via the one-way clutch unit having a tube shaped hub.

The method includes loosely fitting the tube shaped hub to an end of the crankshaft provided with a circumferential slot and axially fixing the hub upon the crankshaft via inserting a clip-ring into the slot such that the hub is axially fixed upon the crankshaft via co-operation of axial movement of the clip-ring via a first and a second axially delimiting member at least partially surrounded by an inner periphery of the tube shaped hub.

Further aspects of the present invention are discussed in more detail herein.

It will be appreciated that features of the invention are susceptible to being combined in any combination without departing from the scope of the invention as defined by the accompany claims.

BRIEF DESCRIPTION OF THE DRAWINGS

By way of example only, embodiments of the present invention will now be described with reference to the accompanying drawings wherein.

Figure 1:
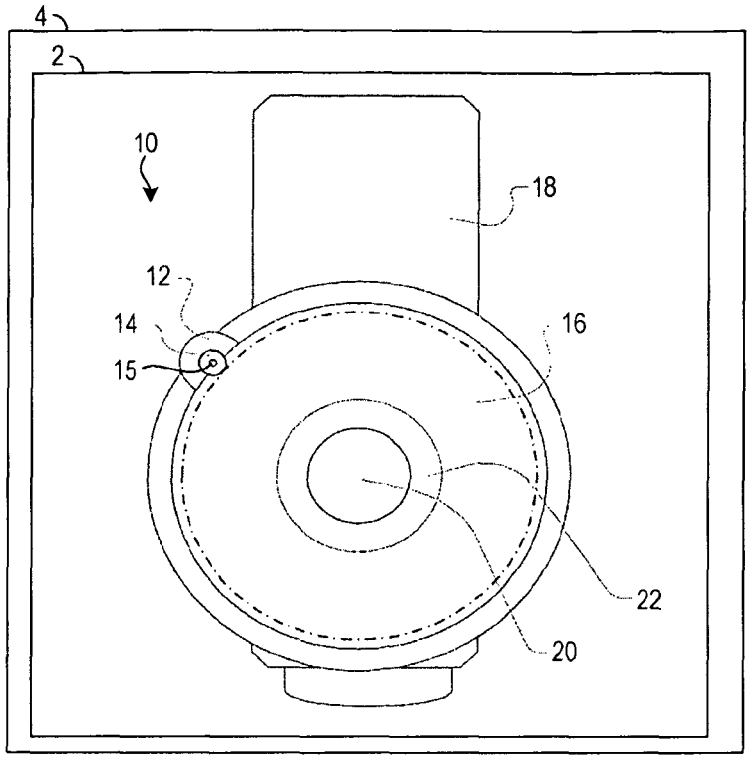
FIG. 1 illustrates a schematic view of a starter arrangement according to the present invention.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein. The same reference numerals will be used for illustrating corresponding features in the different drawings.

DETAILED DESCRIPTION OF EMBODIMENTS

FIGS. 1-4 illustrate various examples of a starter arrangement 10 included in an internal combustion engine 2. The starter arrangement may be easily installed and removed, simplifying the manufacturing as well as the repair process of the internal combustion engine. In this way, the cost of the internal combustion engine and therefore the vehicle may be decreased.

In a first example of the present invention, as shown schematically in FIG. 1, a starter arrangement 10 for an internal combustion engine 2 is illustrated. The internal combustion engine may be included in an automotive vehicle 4. In some examples, the vehicle may be a hybrid vehicle configured to generate two sources of motive power to propel the vehicle. However, in other examples, the vehicle may be another suitable vehicle such as a truck, sedan, etc., utilizing an internal combustion engine as the exclusive source of motive power.

The starter arrangement 10 may include a starter motor 12, which may be electric, having a pinion gear 14 coupled to an output shaft 15 and configured to rotate. The pinion gear 14 may be arranged in constant engagement (e.g. permanently engaged), via continuous meshing, with a corresponding crank gear of a crank wheel 16 configured to rotate. The crank gear may include a plurality of peripherally positioned teeth (not shown), which may be helically aligned, in some examples. However, in other examples, the teeth may not be helically aligned. The crank wheel design may be refined and optimized for generating a minimum of noise during operation. Optimization of design may include bearing selection as well as lubrication design, machining tolerances, etc.

Figure 2:
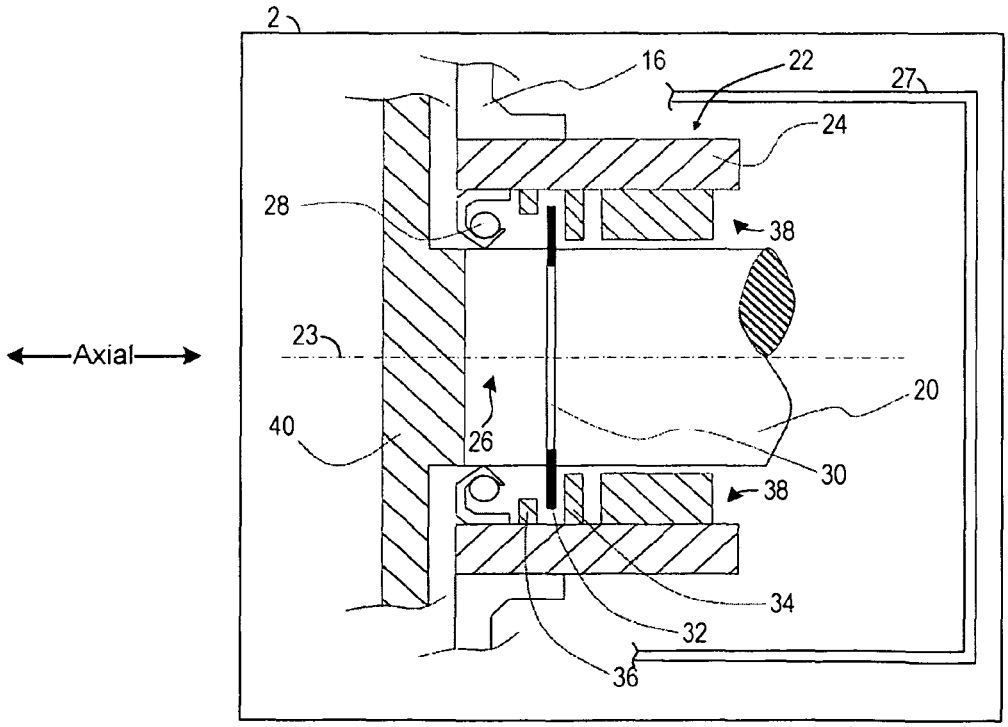
FIG. 2 shows a schematic partial section in the area of the one-way clutch through a first embodiment of the starter arrangement according to FIG. 1.
Figure 3:
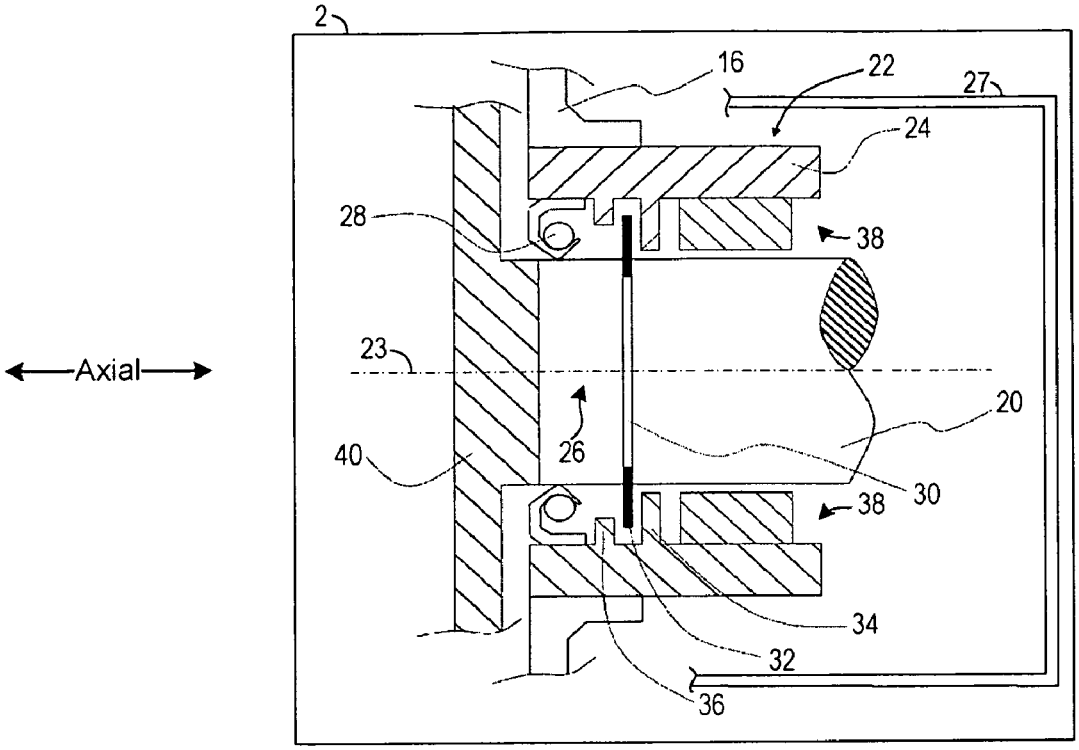
FIG. 3 shows a schematic partial section in the area of the one-way clutch through a second embodiment of the starter arrangement according to FIG. 1.
Figure 4:
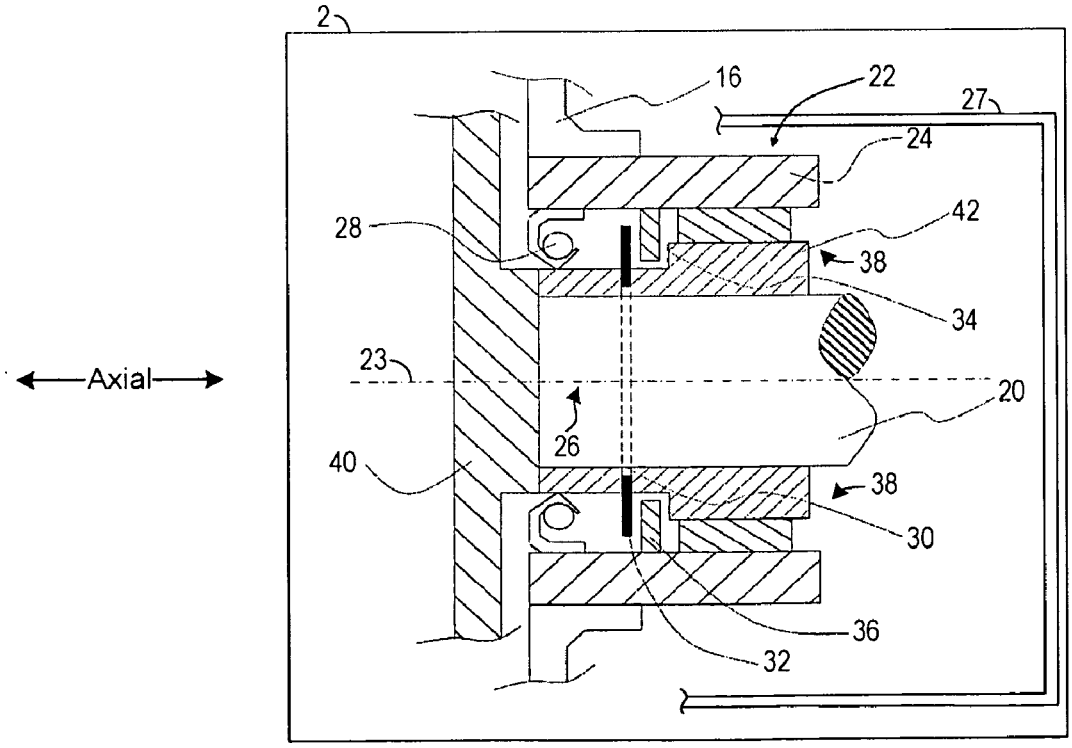
FIG. 4 illustrates a schematic partial section in the area of the one-way clutch through a third embodiment of the starter arrangement according to FIG. 1.

In this example, crank wheel 16 may be positioned between an engine block 18 and a flywheel 40 of the engine, as shown in FIGS. 2-4, discussed in more detail herein. Continuing with FIG. 1, the crank wheel may be concentrically positioned around a crankshaft 20. In this example, a one-way clutch unit 22 may be positioned proximate to the center of the crank wheel. The one way clutch unit may be configured to transfer rotational energy from the crank wheel to the crankshaft via engagement during suitable time intervals, such as during start up. Therefore, during specified time intervals starter motor 12 may operated to drive crank wheel 16, and in turn driving crankshaft 20 via the one-way clutch unit. In this way, starting operation of the internal combustion engine may be initiated through the starter arrangement described above. However, during other time intervals, such as during normal operation of the engine, the one-way clutch unit may freewheel and therefore be disengaged. Normal operation of the engine may include a time period when combustion cycles are occurring within the engine block. It can be appreciated in other examples, that alternate suitable mechanisms may be used to facilitate rotation energy transfer from the crank wheel to the crankshaft.

FIGS. 2-4 illustrate various examples one-way clutch unit 22, discussed above. Therefore similar components are labelled accordingly. As discussed above the one-way clutch unit may be configured to transfer rotational energy to the crankshaft from the starter motor during various operating conditions and under other operating conditions allow free-wheel rotation.

FIG. 2 illustrates crank wheel 16 which may be at least partially surround one-way clutch unit 22. Furthermore, the crank wheel may be operably coupled to the one-way clutch unit. In turn the one-way clutch unit may be operably coupled to the crankshaft, having a central axis of rotation 23, via a tube shaped hub 24, which may be included in the one-way clutch unit. An end 26 of the crankshaft 20 may interiorly extend through at least a portion of the tube shaped hub 26. The tube shaped hub may be loosely fitted to the end of the crankshaft, allowing the tube shaped hub and therefore the one-way clutch to be easily installed and removed during assembly and repair. In some examples, discussed in more detail herein, the tube shaped hub may be pushed or slid onto the crankshaft and loosely fitted to the crankshaft. As used herein, the loose fitting may be contrasted with a press-fit or other tight fitting, such that the loose fitting enables easy installation and removal during assembly and repair.

Additionally, the crankshaft may be rotatably coupled to various components in the engine block, such as one or more pistons (not shown). A crankcase 27 may provide housing for at least a portion of the crankshaft. A first oil seal 28 arranged between one-way clutch unit 22 and crankshaft 20, configured to impede oil from travelling outside of crankcase 27. In this way engine oil may be used to lubricate and/or cool the one-way clutch unit. A second oil seal (not shown) may be positioned between the engine block and the one-way clutch unit and configured to impede oil from travelling into various sections, components, etc., in the engine, such as a clutch (not shown) and/or convertor housing (not shown). The first and/or second oil seal may include various components configured to impede oil, and in some cases gas, from leaking out of the crankcase.

End 26 of crankshaft 20, which is fitted with the hub, is provided with a circumferential slot 30 for receiving a clip-ring 32, which may be milled, casted, welded, etc. The circumferential slot 30 is configured to carry a clip-ring 32 axially fixing the hub 8 upon the crankshaft 5 through a first axially delimiting member 34 and a second axially delimiting member 36, positioned at either side of clip-ring 32. The clip-ring may be inserted into the crankshaft by forcibly sliding the clip-ring into the circumferential slot. The clip-ring is prevented from rotation in the circumferential slot by the compression or clip force exerted on the walls of the circumferential slot. Furthermore, the clip ring axially guides the hub on the crankshaft, limiting (e.g. restricting) the axial movement of the hub via co-operation with the first and second axially delimiting members. Also, the clip-ring may be constructed out of a suitable material such as a metal, composite material, etc., configured to withstand the heat and forces, which may be axial, generated within the one-way clutch unit.

The first and second axially delimiting members may at least partially enclosed by an inner periphery 38 of the tube shaped hub. In some examples, the first and/or second axially delimiting members may be included in the one way hub.

However, in other examples the first and/or second axially delimiting members may be included in another suitable component in the starter arrangement. In this example, the first and/or second axially delimiting members, 34 and 36 respectively, may be ring shaped members. Additionally, in this example, the first and second axially delimiting member may be press fit onto the inner periphery 38 of the tube shaped hub. However, in a second example, illustrated in FIG. 3, the axially delimiting members may be integrally formed with the tube shaped hub. Furthermore it can be appreciated that in other examples, the geometry of the axially delimiting member may be altered depending on various design specifications.

Returning to FIG. 2, a flywheel 40 may be fixedly coupled to the crankshaft, as discussed above. Alternatively, the flywheel may be integrally formed with the crankshaft. Furthermore, flywheel may be configured to store energy in the form of rotational inertia during various operating conditions, such as during an idle stop.

FIG. 4 illustrates a schematic depiction of a third example of a one-way clutch included in the starter arrangement. In the third example, the end of crankshaft 20 is provided with a sleeve 42 which is press fitted onto the end of crankshaft 20. This may be advantageous to the starter arrangement, allowing the end of the crankshaft to be provided with desired characteristics, such as finish and surface hardness, allowing the one-way clutch to efficiently drive the crankshaft under certain operating conditions and freewheel under other operating conditions. The sleeve may be provided with circumferential slot 30 carrying clip-ring 32. In some examples, the sleeve may be included in the first and second examples, as described above with regard to FIGS. 2 and 3.

Returning to FIG. 4, the first axially delimiting member 34 may be integrally formed with sleeve 42. However in other examples, the first axially delimiting member may be coupled to the sleeve via press fitting. A second axially delimiting member 36, coupled to the tube shaped hub 24 via press fitting, may be arranged in between clip-ring 32 and the first axially delimiting member 34. In this way, the axial movement of the first axially delimiting member and therefore the tube shaped hub 24 may be limited by the clip-ring and the second axially delimiting member. Thus, the clip-ring, the first axially delimiting member, and the second axially delimiting member may work in co-operation to fix the axial movement of the hub. It can be appreciated that the second axially delimiting member may be integrally formed with the tube shaped hub or coupled to the tube shaped hub via press fitting.

Alternatively, in another example, clip-ring 32 may be axially arranged between the first and the second axially delimiting members, 34 and 36 respectively. Therefore, the first and second axially delimiting members may be coupled to and/or formed out of sleeve 42.

Returning to the third example, it can be appreciated that to mount or dismount the one way clutch unit from the crankshaft, the clip-ring may be clipped on or off of the crankshaft and subsequently the one way clutch may be slid on or off of the crankshaft, facilitating easy installation and repair. During the installation and/or repair process the press fitted sleeve does not need to be removed from the crankshaft, simplifying installation and repair.

Figure 5:
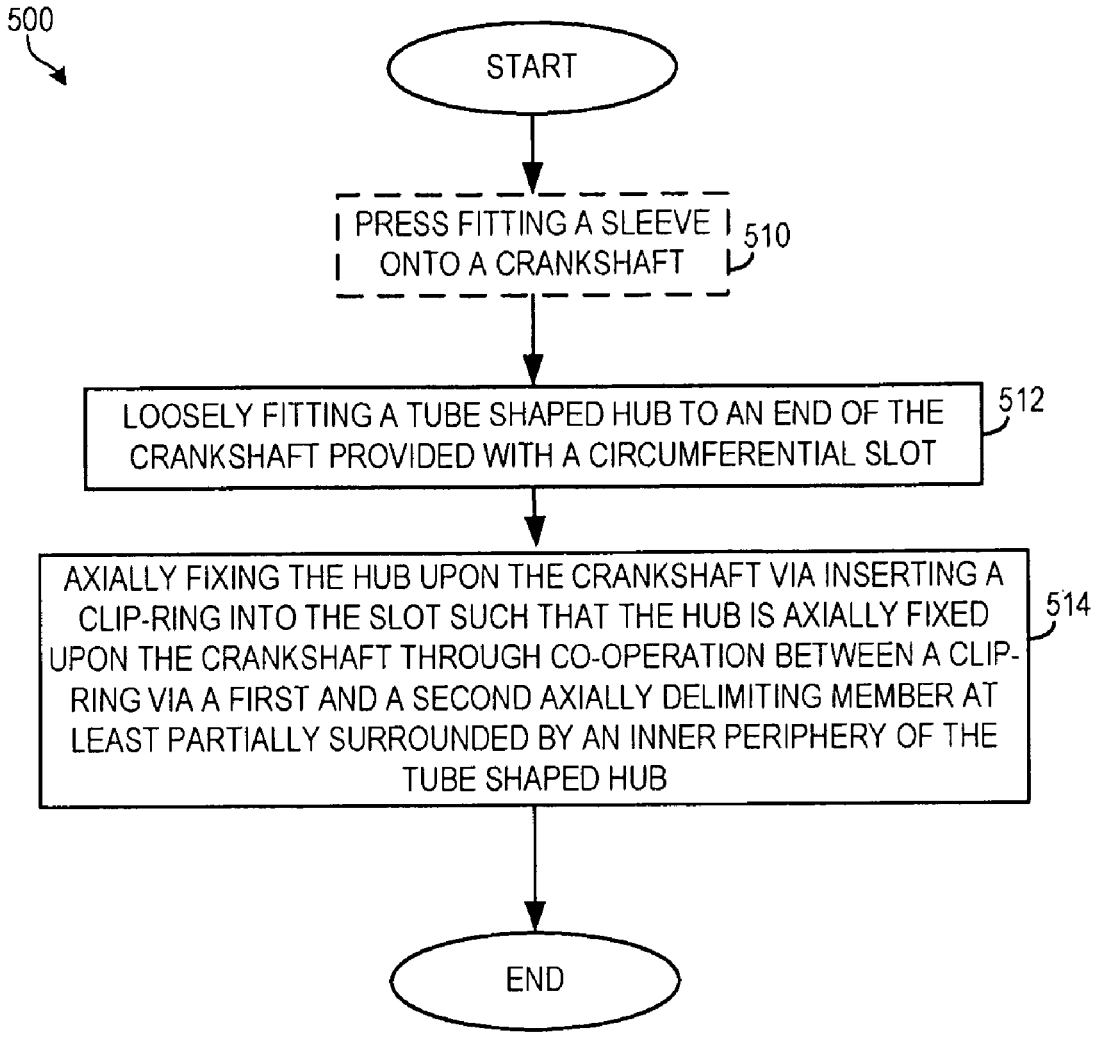
FIG. 5 shows a method which may be used to mount a one way clutch unit onto a crankshaft.

A method 500 for mounting a one-way clutch unit, included in a starter arrangement, onto a crankshaft is illustrated in FIG. 5. In some examples, the starter arrangement may include a pinion gear operably coupled to a starter motor, the pinion gear may be in constant engagement with a corresponding crank gear of a crank wheel located between an engine block and a flywheel of the engine. Additionally, the crank wheel may be operatively connected to a crankshaft of the engine via the one-way clutch unit having a tube shaped hub.

The method may include, at 510, press fitting a sleeve onto the crankshaft prior to fitting the tube shaped hub. In this way, the desired characteristics of the cranks shaft such as surface hardness and finish. However it can be appreciated that in other examples, step 510 may not be included in the method.

Next at 512, the method includes loosely fitting a tube shaped hub to an end of the crankshaft provided with a circumferential slot. Next, at 514, the method includes axially fixing the hub upon the crankshaft via inserting a clip-ring into the slot such that the hub is axially fixed upon the crankshaft through co-operation between a clip-ring via a first and a second axially delimiting member at least partially surrounded by an inner periphery of the tube shaped hub. After 514 the method ends.

The above method for mounting a one-way clutch unit of a starter arrangement onto a crankshaft enables convenient mounting and dismounting of the one-way clutch unit through clipping on and off the clip-ring. In this way the assembly, repair, and disassembly process may be simplified, decreasing the overall cost of the one-way clutch and therefore the vehicle.

Modifications to embodiments of the invention described in the foregoing are possible without departing from the scope of the invention as defined by the accompanying claims.

Expressions such as "including", "comprising", "incorporating", "have", "is" used to describe and claim the present invention are intended to be construed in a non-exclusive manner, namely allowing for items, components or elements not explicitly described also to be present. Reference to the singular is also to be construed to relate to the plural and vice versa.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A starter arrangement for an internal combustion engine the arrangement comprising:

a starter motor having a pinion gear coupled to an output shaft, the pinion gear being arranged in constant engagement with a corresponding crank gear of a crank wheel located between an engine block and a flywheel of the engine, the crank wheel operatively coupled to a crankshaft of the engine via a one-way clutch unit loosely fitted to an end of the crankshaft, the crankshaft including a circumferential slot carrying a clip ring; and the one-way clutch unit comprising a tube shaped hub loosely fitted to an end of the crankshaft, where axial movement of the one-way hub is fixed via a clip-ring in co-operation with a first axially delimiting member and a second axially delimiting member at least partially enclosed by the hub.

2. A starter arrangement according to claim 1, wherein at least one of the axially delimiting members is a ring shaped member and is press fitted onto the hub.

3. A starter arrangement according to claim 1, wherein at least one of the axially delimiting members is integrally formed with the hub.

4. A starter arrangement according to claim 1, wherein the end of the crankshaft is provided with a sleeve which is press fitted onto the end of the crankshaft, which sleeve is provided with the circumferential slot carrying the clip-ring.

5. A starter arrangement according to claim 4, wherein a first axially delimiting member is press fitted onto the sleeve and a second axially delimiting members is coupled to or integrally formed with the hub and is positioned between the first axially delimiting member and the clip-ring.

6. A starter arrangement according to claim 4, wherein a first axially delimiting member is integrally formed with the sleeve and a second axially delimiting member is coupled to or integrally formed with the hub and positioned between the first axially delimiting member and the clip ring.

7. A starter arrangement according to claim 4, wherein the clip-ring is axially interposed between two axially delimiting members, the axially delimiting members integrally formed with or press fitted onto the hub.

8. A starter arrangement according to claim 1, wherein a crankshaft oil seal is arranged between the one-way clutch unit and the flywheel proximate an end of the crankshaft exterior to the axially delimiting members.

9. A starter motor according to claim 1 wherein the internal combustion engine is included in an automotive vehicle.

10. A method for mounting a one-way clutch unit, included in a starter arrangement for an internal combustion engine, onto a crankshaft, the starter arrangement including a starter motor having a pinion gear operably coupled to a starter motor, the pinion gear in constant engagement with a corresponding crank gear of a crank wheel located between an engine block and a flywheel of the engine, and the crank wheel operatively connected to a crankshaft of the engine via the one-way clutch unit having a tube shaped hub, the method comprising:

loosely fitting the tube shaped hub to an end of the crankshaft provided with a circumferential slot; and axially fixing the hub upon the crankshaft via inserting a clip-ring into the slot such that the hub is axially fixed upon the crankshaft through co-operation between a clip-ring via a first and a second axially delimiting member at least partially surrounded by an inner periphery of the tube shaped hub.

11. The method according to claim 10 further comprising press fitting a sleeve onto the crankshaft prior to fitting the tube shaped hub.

12. The method according to claim 10 wherein at least one of the axially delimiting members is press fitted onto the tube shaped hub.

13. A starter arrangement for an internal combustion engine comprising:

a crankshaft with an end extending out of a block of the engine, the end of the crank shaft including a circumferential slot;

a crankwheel;

a starter motor in constant engagement with the crank wheel via a pinion gear;

a one-way clutch unit rotatably coupling the crank wheel to the crankshaft, the one-way clutch unit including a tube shaped hub coupled to the end of the crankshaft; and a clip-ring carried in the circumferential slot, the clip-ring axially fixing the tube shaped hub via a first and a second axially delimiting member at least partially enclosed by an inner periphery of the tube shaped hub.

14. The starter arrangement according to claim 13 further comprising a flywheel coupled to the crankshaft exterior to the tube shaped hub and a crankshaft of the engine, where the one-way clutch is interposed between the flywheel and the engine block.

15. The starter arrangement according to claim 13 further including a sleeve loosely fitted onto the crankshaft including the first axially delimiting member.

16. The starter arrangement according to claim 15 wherein the second axially delimiting member is axially arranged between the clip-ring and the first axially delimiting member.

17. The starter arrangement according to claim 13 wherein the crankshaft extends through at least a portion of the tube shaped hub.

18. The starter arrangement according to claim 13 wherein the internal combustion engine is included in a hybrid vehicle.

19. The starter arrangement according to claim 13 wherein the pinion gear and the crank wheel are configured to reduce noise and/or vibration during operation of the starter motor.

20. The starter arrangement according to claim 13 further comprising a first oil seal positioned between the flywheel and the tube shaped hub.

* * * * *